United States Patent [19]

Gryctko

[11] 3,958,197

[45] May 18, 1976

[54] HIGH INTERRUPTING CAPACITY GROUND FAULT CIRCUIT BREAKER

[75] Inventor: Carl E. Gryctko, Haddon Heights, N.J.

[73] Assignee: I-T-E Imperial Corporation, Spring House, Pa.

[22] Filed: Jan. 24, 1975

[21] Appl. No.: 543,864

[52] U.S. Cl. ..... 335/18; 317/18 D; 337/6

[51] Int. Cl.[2] ..... H01H 83/00; H01H 83/02

[58] Field of Search ..... 335/18; 317/18 D; 337/6

[56] References Cited

UNITED STATES PATENTS

| | | | |
|---|---|---|---|
| 3,440,579 | 4/1969 | Smith | 335/18 |
| 3,493,815 | 2/1970 | Hurtle | 317/18 D |
| 3,579,038 | 5/1971 | Backderf | 317/18 D |
| 3,599,135 | 8/1971 | Gryctko | 337/6 |
| 3,636,482 | 1/1972 | Edmunds | 317/18 D |
| 3,855,502 | 12/1974 | Pardue | 335/18 |

*Primary Examiner*—Harold Broome

*Attorney, Agent, or Firm*—Ostrolenk, Faber, Gerb & Soffen

[57] ABSTRACT

A circuit protective arrangement which utilizes a circuit breaker, current limiting fuse and ground fault interruption means in a closely coordinated operation to achieve reliable current interruption in the event that an overcurrent or ground fault hazard occurs. The source voltage is above the voltage rating of both the circuit breaker and current limiting fuse devices and the available current from the source is in excess of the rated current interruption rating of the circuit breaker. A compact sectionalized or modular structure for replacement of an existing circuit breaker is shown.

6 Claims, 4 Drawing Figures

HIGH INTERRUPTING CAPACITY GROUND FAULT CIRCUIT BREAKER

BACKGROUND OF THE INVENTION

This invention relates to circuit protective arrangements and more particularly relates to a novel high capacity circuit breaker having coordinated ground fault interruption means.

It is known to series connect a circuit breaker and current limiting fuse device to achieve reliable current interruption when connected to a source having an available current in excess of the rated current interruption rating of the circuit breaker, even when the source voltage is above the rated voltage of both the circuit breaker and current limiting fuse devices, as in U.S. Pat. No. 3,599,135 issued Aug. 10, 1971, to the assignee of the present invention. There is presently a great interest in providing ground fault protection for operation with circuit protective arrangements useful in light and medium industrial applications at relatively low costs.

In the prior art coordinated operation of the circuit breaker and current limiting fuse devices, where a current interrupting process is initiated by closely-cooperating thermal, electromagnetic, fuse protection and fuse removal means, it is necessary to have a unit with high component density in the area of the circuit breaker separable-contact trip mechanism. This high packaging density has hitherto not allowed the incorporation of ground fault protection means cooperating with the trip mechanism to provide desired additional protection in the event of a ground fault condition occurring in a power utilization device or on the pair of power lines coupling such device to the circuit breaker.

BRIEF DESCRIPTION OF THE INVENTION

It is desirable to include ground fault protection means in a circuit breaker having coordinated operation with a current limiting fuse device for high current interrupting capacity while maintaining closely cooperating means for thermal, electromagnetic and fuse removal protection.

In accordance with the invention, a high interrupting capacity ground fault circuit breaker realizing these goals includes a unitized molded case comprising a pair of sections, with a circuit breaker and current limiting fuse contained in a first section or module thereof and ground fault protection means contained in a second section or module thereof. The known interruption characteristics of the circuit breaker and current limiting fuse are predeterminedly coordinated such that the rated voltage value of both the fuse and the circuit breaker are each significantly less than the allowable source voltage and the current limiting fuse interrupts the flow of current through the device at a predetermined fuse interrupting current value which is significantly less than the circuit breaker rated interruption current to prevent the circuit breaker from being subject to an interruption current at the source voltage in excess of the kva rating of the circuit breaker. The circuit breaker includes a pair of cooperating contacts and operating means for moving the contacts between their engaged and disengaged positions responsive to predetermined circuit breaker interruption characteristics; the ground fault protection means includes an actuatable member extending into the circuit breaker section without interferring with the existing thermal, electromagnetic, fuse removal and current limiting protective mechanisms and yet closely positioned to the operating means to cause, without additional trip mechanism components, movement of the contacts to their disengaged position responsive to a protective ground fault condition caused by a high impedance fault to earth ground between the output terminals of the circuit breaker and a power utilization device connected thereto.

The high interrupting capacity ground fault circuit breaker just described has the advantage that it permits automatic interruption of the current flowing in a circuit between an energy source and a power utilization device for both overcurrent and ground fault hazards while maintaining close cooperation between the circuit breaker components necessary for current interruption by the thermal, electromagnetic, current limiting fuse and ground fault interruption protective means, without requiring additional trip mechanism components.

Accordingly, it is a primary object of the present invention to provide novel apparatus for interruption of a high current capacity circuit in response to a detected ground fault condition.

It is another object of the present invention to achieve such ground fault interruption capability while maintaining thermal, electromagnetic and current limiting fuse protection for overcurrent hazards.

A further object is to provide apparatus to realize such interruption capability in a closely coordinated manner.

It is a still further object of the present invention to provide such apparatus in a compact, sectionalized molded case for ease of installation.

The above as well as other objects of the invention will become apparent from the following description of the accompanying drawings.

DETAILED DESCRIPTION OF THE INVENTION

Figure 1:
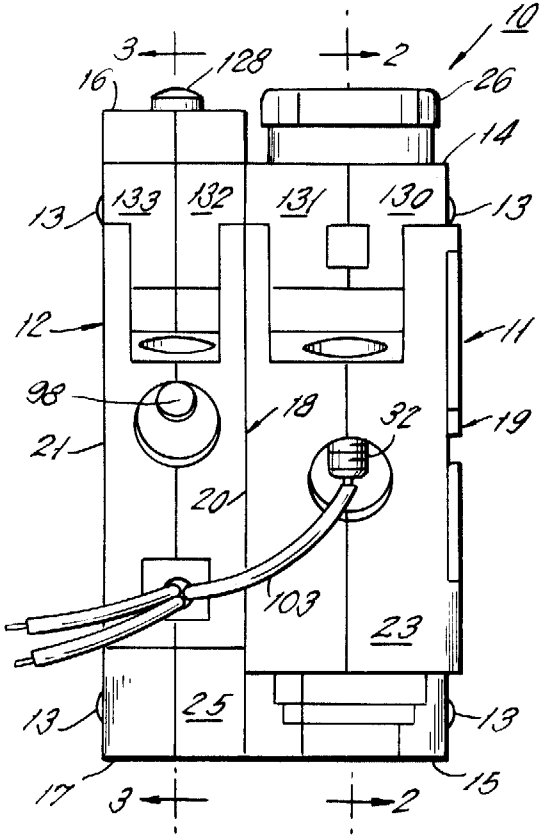
FIG. 1 is a load end or rear elevation of a high interrupting capacity ground fault circuit breaker in accordance with the invention.

Referring to FIG. 1 of the drawings, high current capacity ground fault circuit breaker 10 includes a sectionalized casing having circuit breaker and current limiting fuse section 11 and ground fault detection section 12 maintained in side-by-side relationship and secured each to the other by a plurality of rivets 13.

The molded case thus includes a first pair of opposed top and bottom walls, 14, 15, respectively; a second pair of opposed top and bottom walls 16, 17, respectively; a pair of opposed first and second sidewalls 18, 19, respectively; a pair of opposed third and fourth sidewalls 20, 21, respectively; a third pair of opposed front and rear walls 22, 23, respectively; and a sixth pair of opposed front and rear walls 24, 25, respectively. The internal volume bounded by the above-noted walls 14, 15, 18, 19, 22 and 23 contains a circuit breaker device and a current limiting fuse receptacle 26 with a series circuit connection provided therebetween.

Figure 4:
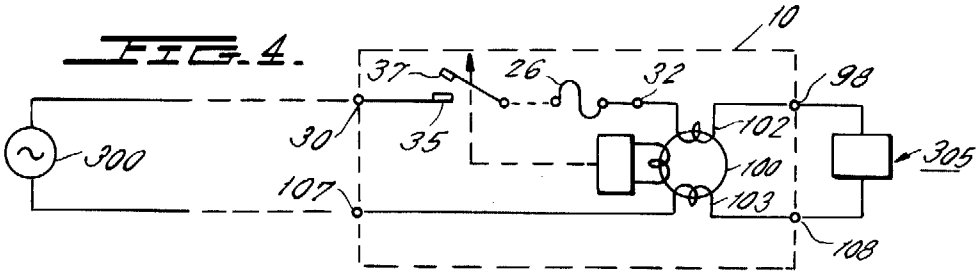
FIG. 4 is a schematic showing the unitized device of FIG. 1 connected in circuit with a source of electrical energy and a power utilization device.

Referring now to all the drawings, unitized device 10 includes an external line terminal 30, which is connected to an external source of electrical energy 300 (FIG. 4) in the conventional manner. This terminal is shown as a bolt-type terminal; however, it should be understood that any type of terminal adequate to carry at least the maximum fuse interrupting current may alternatively be employed. Auxiliary terminal 32 at the opposite side of circuit breaker section 11 provides for a connection to the ground fault protection section 12, as hereinafter described. The first sidewall 18 includes a first plurality of recesses and also an elongated slot 34 whose position and function will be later described. Second sidewall 19 includes a second plurality of recesses which cooperate with the first plurality of recesses in the first sidewall 18 for receiving and locating the various operating components of the circuit breaker section 11. Located within one such recess is a stationary contact 35 which is connected to line terminal 30 by a conductive member 36. Cooperating with stationary contact 35 is a movable contact 37, mounted to the lower end of a contact arm 38. Parallel plate arc extinguishing means 39 is provided within recesses 40. The upper bifurcated end 41 of contact arm 38 abuts a suitable pivot formation 42 of internally extending portion 44 of manual operating member 45. Manual operating member 45 is pivoted about protrusions 46 which are entered into suitable aligned recesses of the first and second sidewalls 18 and 19. The manual operating member includes an outwardly extending portion 47 for manually moving the circuit breaker between its manual OFF and manual ON positions.

Contact carrying arm 38 has a braid member 48 secured thereto, with the opposite end of the braid member being connected to braid lug 49. The electrical path then continues through bimetallic member 50, braid 51, and conductor 52 to an electromagnetic coil 53. Electromagnetic coil 53 is electrically connected via conductor 54 to one terminal of fuse receptacle 26. The circuit then continues through a current limiting fuse device contained within fuse receptacle 26 to a second fuse terminal 55 of fuse receptacle 26 which is connected to auxiliary terminal 32.

Thus circuit breaker section 11 includes a series circuit path from line terminal 30 via stationary and movable contacts 35, 37, bimetallic member 50, electromagnetic trip coil 53 and fuse means 26 to the auxiliary terminal 32.

Figure 2:
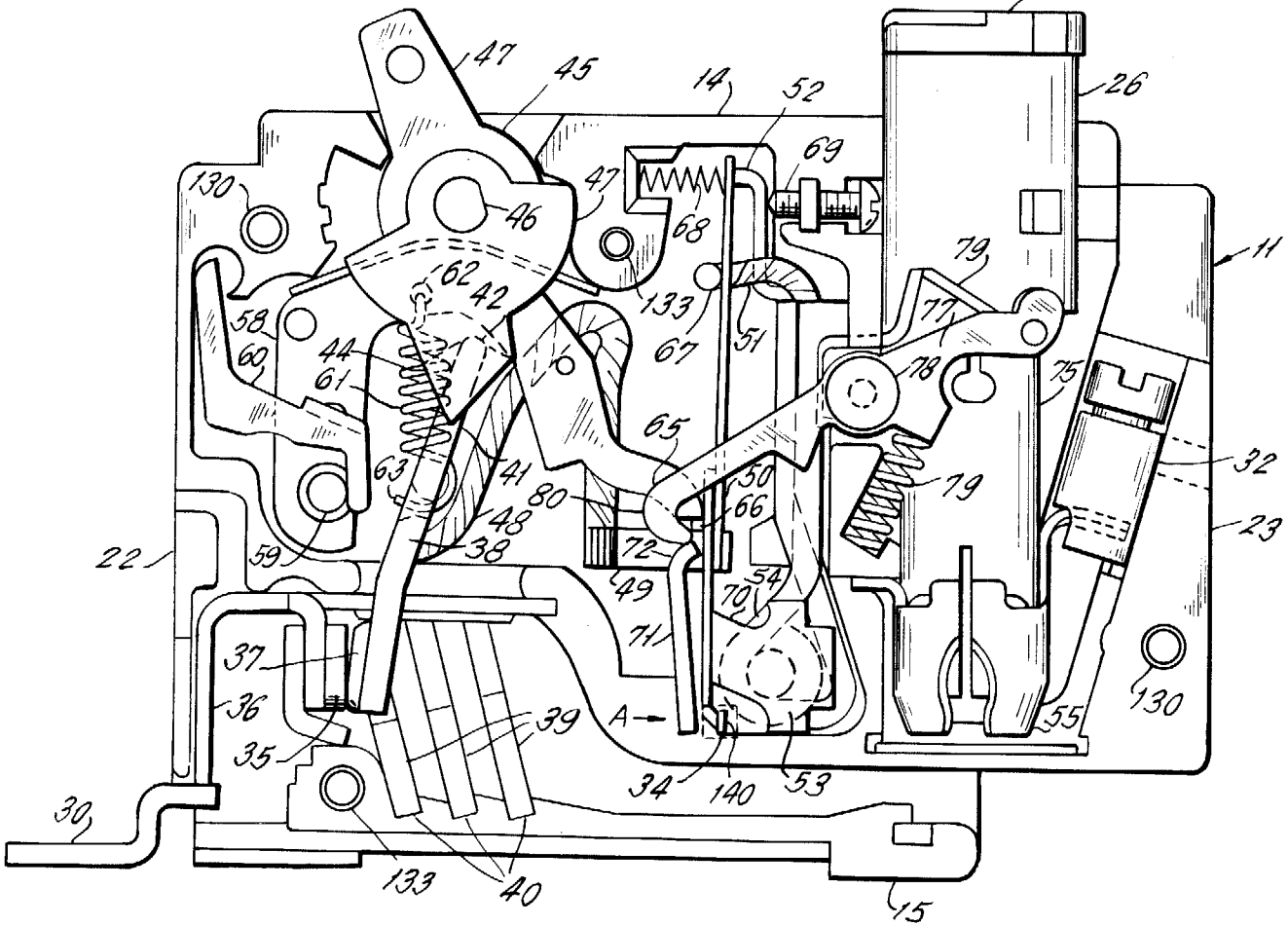
FIG. 2 is a side view of the circuit breaker section in accordance with the present invention, taken along the line 2—2 of FIG. 1, showing the coordinated circuit breaker device and current limiting fuse, in the contact engaged condition.

The operating mechanism for bringing about the engagement and disengagement of cooperating contacts 35, 37 comprises a latchable cradle member 58 which is pivotally mounted at one end thereof to sidewall protrusion 59. Cradle 58 also includes a kicker 60 which gives contact arm 38 a hammer-like blow during the tripping operation to ensure separation of the circuit breaker contacts. One end of an operating spring 61 is connected to cradle 58 at aperture 62 while the other end of operating spring 61 is connected to contact arm 38 at aperture 63. Operating spring 61 is always in tension, thereby urging contact arm end 41 upwardly into engagement with its pivotal mounting formation 42 of manual operating member 45, and latchable cradle member 58 clockwise about its pivotal mounting 59. The force of operating spring 61 also serves to urge the movable contact 37 into firm engagement with its cooperating stationary contact 35, as shown in FIG. 2.

Latchable cradle member 58 includes latchable tip 65 which seats upon latch portion 66 carried by the lower region of elongated bimetallic member 50. A bearing pin 67 is suitably secured to an intermediate region of elongated bimetallic member 50, as by welding, and enters suitable circular recesses in the first and second sidewalls 18, 19 for pivotally mounting the bimetallic member. The elongated bimetallic member 50 is biased in a clockwise direction about its pivot 67 by spring 68. Calibrated adjustment of the trip unit is obtained by calibrating screw 69 which bears against intermediate connecting member 52.

The electromagnetic actuation of the circuit breaker device is provided by coil 53 in conjunction with pole pieces 70, which upon actuation draws the armature member 71 towards the pole pieces. As the armature member 71 is drawn toward the pole pieces, its upper end 72 will strike the lower region of bimetallic member 50, thereby moving it in a counterclockwise direction. The sustaining of a moderate overload condition similarly deflects the bimetallic member in the same counterclockwise direction. This counterclockwise movement of the lower end of bimetallic member 50 serves to release the latch engagement between cradle tip 65 and latch member 66, so as to bring the circuit breaker mechanism to the overload TRIP condition and cause the movable contact 37 and the manual operating member 45 to move to their disengaged positions.

Fuse receptacle 26 retains a current limiting fuse device inserted in compartment 75 and held in place by fuse receptacle cap 76. An interlock trip lever 77 pivotally mounted at 78 cooperates with cam surface 79 of the fuse receptacle cap 76 to coordinate the tripping of the circuit breaker to the insertion and removal of the fuse device. Interlock lever 77 is biased counterclockwise about its pivot 78 by spring member 79, such that lever end 80 is urged into engagement with the lower region of bimetallic member 50 by cam surface 79 when fuse receptacle cap 76 is rotated to its fuse removal position. The interlock lever 77 is moved clockwise against the biasing action of spring 79 when the fuse is fully inserted, so as to prevent the engagement of end 80 with bimetallic member 50. Initiation of fuse removal causes interlock lever 77 to be moved counterclockwise against the biasing action of spring 79, whereby end 80 causes sufficient counterclockwise movement of bimetallic member 50 to defeat the latched engagement of cradle trip 65 with latch member 66. The circuit breaker mechanism will thus be in the TRIP condition when the fuse receptacle cap 76 is in a position to permit fuse removal. The fuse may only be inserted in fuse receptacle 26 when the circuit breaker section 11 is in the contact disengaged condition.

The internal volume bounded by the above-noted walls 16, 17, 20, 21, 24 and 25 contains a ground fault detector and an actuatable member 95 connected thereto.

Figure 3:
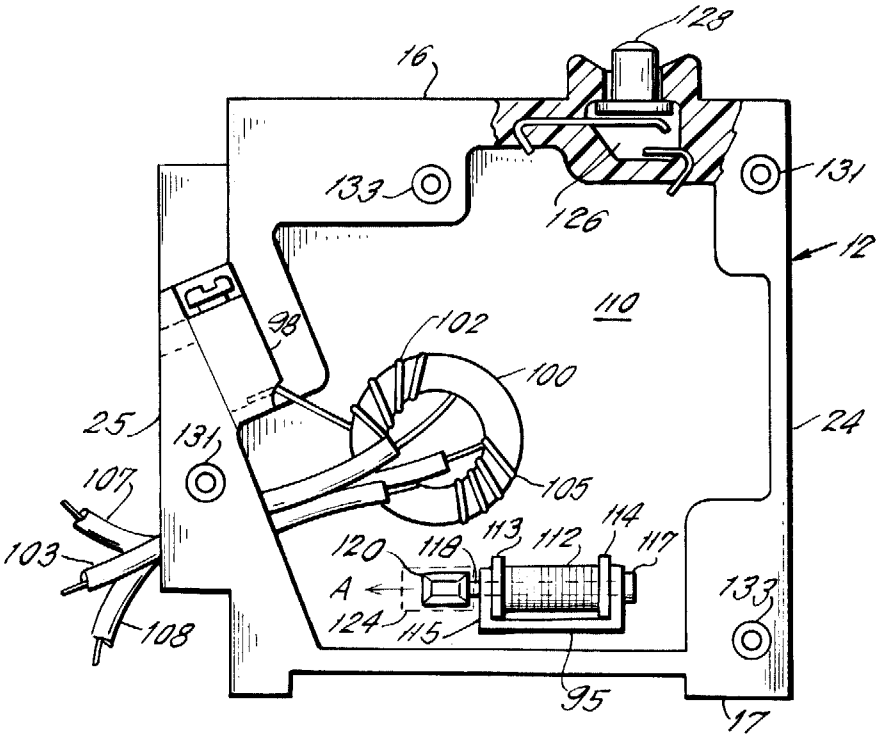
FIG. 3 is a side view of the ground fault detection section constructed in accordance with the objectives of the instant invention, taken along the line 3—3 of FIG. 1.

Referring now especially to FIG. 3, ground fault detection section 17 includes an external load terminal 98, to which is connected one terminal of an external power-utilization device 305 (FIG. 4) in the conventional manner. Ground fault detection means includes a balanced differential transformer 100 having first and second primary windings 102, 103, respectively, each having an identical small number of turns. One lead of primary winding 102 is connected to external load terminal 98, while the remaining lead 103 of the first primary winding passes through rearwall 25 of ground fault protection section 12 and is connected to auxiliary terminal 32 of circuit breaker section 15, to complete the electrical circuit between one terminal of energy source 300 and one terminal of power utilization device 305. The second primary winding 105 of differential transformer 100 has a pair of leads 107, 108 which also pass through rearwall 25. The appropriately marked input lead 107 is connected to the remaining terminal of energy source 300 while lead 108 connects the high interrupting capacity ground fault circuit breaker unit 10 to the remaining terminal of power utilization device 305. An ouput winding (not shown) of differential transformer 100 is connected to circuit board 110, which contain known amplification and detection circuitry. Actuatable member 95 includes coil 112 wound between a pair of pole pieces 113, 114 contained on frame member 115. Linearly actuatable armature 117 is positioned within the bore of coil winding 112 and is axially injected toward the center of the coil winding when coil winding 112 is energized. Rod-like extension 118 is attached to the end of armature 117 closest to pole piece 113, and includes contact portion 120 which transversely extends from the free end of extension 118 in a direction away from circuit board 110.

First and second primary windings 102, 105 are wound in opposite directions, such that equal current flow through each of the windings induces equal and opposing magnetic flux within the toroidal core of transformer 100. Additional current flow through either winding, responsive to a high impedance short-circuit from either power line to earth ground, provides an unbalanced net flux which induces a current in the third or secondary winding of transformer 100. The "unbalance" current is detected and amplified by the components (not shown) contained on circuit board 110 to produce an output signal for energizing coil winding 112 to inject armature 117 toward the center of the coil winding and cause actuating or contact portion 120 to move toward the rear wall 25 of ground fault detection section 12, in the direction indicated by arrow A. Contact portion 120 extends through elongated slot 124 in the third sidewall 20.

Ground fault detection section 12 further contains normally-open test switch means 126 and test push button 128 contained in aligned formations in the top wall 16 of ground fault detection section 12. Test push button 128 is depressed to form a completed circuit within switch means 126 which is connected to circuit board 110 to cause a current-unbalance condition to appear in differential transformer 100, whereby a simulated ground fault is sensed by detection circuitry 110 to energize coil winding 112 and cause contact portion 120 to be moved in the direction of arrow A, in exactly the same manner as for a true ground fault presented between external load terminal 98 and load connection lead 108.

The first and second sidewalls 18, 19, respectively, of circuit breaker section 11 each contains a first pair of aligned recesses 130, 130 through which fastening means extend to secure the two housing half-sections of circuit breaker section 11 together as a single section of the device. The third and fourth sidewalls 20, 21, respectively, each contains a second pair of recesses 131, 131 through which other fastening means extend to maintain the two housing half-sections of ground fault detector section 12 together to form the single housing of ground fault detection section 12. Each of the sidewalls 18, 19, 20, 21 is provided with additional pairs of aligned recesses 133, 133 through which additional fastening means extend to secure circuit breaker section 11 and ground fault detection section 12 in close side-by-side relationship each to the other. Sidewalls 18, 19, 20, 21 are each provided with positioning abutments which surround recesses 130, 131, 133. First sidewall elongated slot 34 in close alignment with third sidewall elongated slot 124 and with contact portion 120 transversely extending into the interior volume of circuit breaker section 11 and closely positioned in front of contact tip 140 which transversely extends from the lower end of bimetallic member 50. A third plurality of rivets 13 extend through passages in the third plurality of recess-abutment pairs 133 to secure circuit breaker section 11 and ground fault detection section 12 together to form the unitized high current capacity ground fault circuit breaker 10.

In operation, an overcurrent hazard or fuse removal causes bimetallic member 50 to be rotated in a counterclockwise direction, as set forth above. A ground fault condition causes the unbalance of differential transformer 100 thereby energizing coil 112 thereby moving contact portion 120 in the direction indicated by arrow A. Closely aligned elongated housing slots 34, 124 are formed to guide contact portion 120 against contact tip 140 and rotate bimetallic member 50 in a counterclockwise direction about pivot 67, whereby free end 65 of cradle member 58 is released by latch tip 66, causing tension spring 61 to rotate contact arm 38 about its pivot portion 42 and separate movable contact 37 from stationary contact 35, while manual operating member 45 is moved to indicate the OFF condition. Subsequent retention of manual operating member 47 in the manual ON position is not possible in the presence of either overcurrent or ground fault hazards, as cradle end 65 cannot be engaged by latch tip 66 due to the continuing counterclockwise rotation of latch tip 66 by bimetallic member 50, interlock trip lever 77, armature 71 of electromagnetic trip coil 53 or ground fault hazard returns each of the coordinated trip mechanisms 50, 71, 77 and 120 to their non-trip biased positions. Spring 68 causes bimetallic member 50 to rotate in a clockwise direction such that contact tip 140 presses against contact portion 120 whereby linearly actuated armature 117 is ejected to its non-energized position at the end of the bore of coil winding 112, enabling ground fault detection section 12 for a subsequent actuation upon detection of a subsequent ground fault.

There has just been described a novel high interrupting capacity ground fault circuit breaker having a unitized housing containing a circuit breaker closely coordinated with current limiting fuse means and ground fault detection means closely cooperating with existing high-density packaged circuit breaker trip mechanisms without requiring te alteration or addition of components to the existing trip mechanism.

Although a preferred embodiment of this novel invention has been described herein, many variations and modifications will now be apparent to those skilled in the art. Therefore, I prefer to be limited not by the specific disclosure herein, but only by the appended claims.

What is claimed is:

1. Protective apparatus for connection in series between a source of electrical energy and an external power utilization device to automatically interrupt current flow therebetween upon the occurrence of predetermined fault conditions;

said apparatus including the series combination of a circuit breaker, a current limiting fuse device, and ground fault interruption means;

said current breaker including a pair of cooperating contacts, manually operable first means for moving said contacts between their engaged and disengaged positions, and an elongated bimetallic member having a first end including pivot means and a second end having a contact tip;

said elongated member including second means directly coupled to said first means for automatically moving said contacts to their disengaged position in response to predetermined overcurrent fault conditions causing rotation of said elongated member about said pivot means;

third means directly coupled to said elongated member for automatically moving said contacts to their disengaged position responsive to initiating disconnection of said fuse device from said circuit breaker;

said circuit breaker having a predetermined interruption characteristic in a maximum permissible rated interruption current value at a rated voltage value to define its maximum kva. capacity, said rated interruption current value being less than the maximum current available from the source;

said current limiting fuse device having a predetermined current interruption value and a rated voltage value;

said interruption characteristics of said circuit breaker and current limiting fuse device being predeterminately coordinated such that the rated voltage values of said fuse device and said circuit breaker are each significantly less than the voltage of said source; and said predetermined fuse interrupting current value is significantly less than said circuit breaker rated interrruption current, thereby to prevent the subjection of said circuit breaker to an interruption current in excess of said predetermined fuse interrupting value, at said voltage of said source;

said ground fault interruption means including an actuatable member and fourth means for detecting a ground fault condition, said actuatable member being energized by said fourth means in response to ground fault conditions in excess of a predetermined value;

said actuatable member being actuated directly against said contact tip to rotate said elongated member about said pivot means to operate said second means and automatically cause said contacts to move to their disengaged position, thereby interrupting current flow to said power utilization device in the event of said ground fault conditions.

2. Protective apparatus as set forth in claim 1, further comprising electromagnetic means having an armature directly coupled to said elongated member to cause rotationg of said member about said pivot means to operate said second means responsive to a fault current in excess of a predetermined value.

3. Protective apparatus as set forth in claim 1, further comprising a sectionalized housing including a first module and a second module;

said first module including a first pair of opposed front and rear walls, containing therebetween said circuit breaker including said pair of cooperating contacts, said first, second and third means, and said current limiting fuse device;

line terminal means extending through said first module front wall for connecting said circuit breaker to said source;

first auxiliary terminal means extending through said first module rear wall for connecting said current limiting fuse device to said ground fault interruption means; and circuit means for series circuit connecting said circuit breaker and said current limiting fuse device between said line and first auxiliary terminal means.

4. Protective apparatus as set forth in claim 3, wherein said first module further includes a pair of opposed first and second sidewalls and said second module includes a pair of opposed front and rear walls and a pair of opposed third and fourth sidewalls, containing therebetween said ground fault interruption means including said ground fault detection means and said actuatable member;

second auxiliary terminal means extending through said second module rear wall for connecting said ground fault detection means to said first auxiliary terminal means;

said first module second sidewall having a first elongated slot therein, said first elongated slot being positioned adjacent to said contact tip of said elongated member;

said second third sidewall having a second elongated slot formed therein, said second elongated slot being positioned adjacent said actuatable member; and means for locating and securing said first and second sections in side-by-side relationship with said first section second sidewall and said second section third sidewall in abutment and with said first and second elongated slots in alignment, whereby said actuatable member is closely positioned to said contact tip to actuate said second means to automatically cause said contacts to move to their disengaged position when said actuatable member is energized.

5. A combination as set forth in claim 4, wherein said actuatable member comprises a linearly actuatable solenoid including a coil winding and an armature, said armature being movable along an axis of said coil winding; and a contact member coupled to said armature;

said contact member being closely positioned to said contact tip to enable said second means to move said contacts to their disengaged position when said coil winding is energized.

6. A combination as set forth in claim 5, wherein said solenoid axis is positioned parallel to said second case section third sidewall and said contact member transversely extends from said axis through said first and second elongated slots to said contact tip.

* * * * *